US009982426B2

(12) United States Patent
Desautels et al.

(10) Patent No.: US 9,982,426 B2
(45) Date of Patent: May 29, 2018

(54) ENHANCED DECK ASSEMBLY FACILITATION METHODS AND SYSTEMS

(71) Applicant: JD Concepts LLC, Redmond, WA (US)

(72) Inventors: John Fredrick Desautels, Mill Creek, WA (US); Joel Douglas Skillingstead, Redmond, WA (US)

( * ) Notice: Subject to any disclaimer, the term of this patent is extended or adjusted under 35 U.S.C. 154(b) by 0 days. days.

(21) Appl. No.: 14/121,351

(22) Filed: Aug. 21, 2014

(65) Prior Publication Data

US 2015/0052845 A1 Feb. 26, 2015

Related U.S. Application Data

(60) Provisional application No. 61/959,379, filed on Aug. 22, 2013, provisional application No. 61/959,380, filed on Aug. 22, 2013.

(51) Int. Cl.

| | |
|---|---|
| ***E04B 1/19*** | (2006.01) |
| ***E04F 19/06*** | (2006.01) |
| ***E04H 12/22*** | (2006.01) |
| ***E04C 3/36*** | (2006.01) |
| ***E04B 1/00*** | (2006.01) |
| ***E04B 1/58*** | (2006.01) |
| ***E04B 1/61*** | (2006.01) |

(52) U.S. Cl.

CPC ..... *E04B 1/1903* (2013.01); *E04B 1/003* (2013.01); *E04B 1/58* (2013.01); *E04B 1/6108* (2013.01); *E04C 3/36* (2013.01); *E04F 19/064* (2013.01); *E04H 12/2292* (2013.01); *E04B 2001/5868* (2013.01)

(58) Field of Classification Search

CPC ..... E04B 1/003; E04B 1/19; E04B 1/6803; E04B 1/665; E04B 1/1903; E04B 1/58; E04B 1/6108; E04B 2001/5868; E04C 3/30; E04C 3/36; E04H 12/2292; E04H 12/2253; E04H 12/2261; E04H 12/2269; E04F 13/06; E04F 2013/063; E04F 11/1812; E04F 15/02183; E04F 19/022; E04F 19/064

USPC ..... 52/650.3, 832, 834, 835, 272, 273, 281, 52/282.3, 287.1, 288.1

See application file for complete search history.

(56) References Cited

U.S. PATENT DOCUMENTS 3,090,087 A * 5/1963 Miller ..... 52/287.1
3,742,668 A * 7/1973 Oliver ..... E04F 19/028 52/288.1

(Continued)

FOREIGN PATENT DOCUMENTS

DE 10105236 A1 * 8/2002 ..... E04F 13/06

OTHER PUBLICATIONS

Machine translation of DE 10105236A1, obtained from https://patentscope.wipo.int/search/en/detail.jsf?docId=DE103525915&recNum=1&maxRec=&office=&prevFilter=&sortOption=&queryString=&tab=PCTDescription (last accessed Mar. 11, 2016).*

(Continued)

*Primary Examiner* — Theodore V Adamos

(74) *Attorney, Agent, or Firm* — Christopher Mayle; John Houvener; Bold IP, PLLC

(57) ABSTRACT

Structures and protocols are presented for providing enhanced assembly tolerances (for thermal or manufacturing variations, e.g.) in constructing gazebos or other standalone decking systems, decks adjoining a house or other primary structure, or other such structures for walkways or human occupancy.

14 Claims, 13 Drawing Sheets

(56) References Cited

U.S. PATENT DOCUMENTS

| | | | | |
|---|---|---|---|---|
| 4,189,885 | A * | 2/1980 | Fritz | 52/287.1 |
| 5,074,084 | A * | 12/1991 | Kriss | 52/73 |
| 5,459,969 | A * | 10/1995 | Stibolt et al. | 52/254 |
| 5,542,222 | A * | 8/1996 | Wilson et al. | 52/287.1 |
| 5,771,646 | A * | 6/1998 | DeSouza | 52/263 |
| 5,901,525 | A * | 5/1999 | Doeringer et al. | 52/835 |
| 5,916,101 | A * | 6/1999 | Stibolt | 52/254 |
| 6,141,928 | A * | 11/2000 | Platt | 52/296 |
| 6,886,296 | B1 * | 5/2005 | John et al. | 52/170 |
| 7,908,812 | B2 | 3/2011 | Eberle, III | |
| 7,926,226 | B2 | 4/2011 | Pope | |
| 8,091,500 | B2 | 1/2012 | Stroud | |
| 8,235,348 | B1 * | 8/2012 | Curtis | 248/548 |
| 8,256,614 | B1 | 9/2012 | Wadsworth, Sr. | |
| 8,272,190 | B2 | 9/2012 | Schiffmann et al. | |
| 8,291,647 | B2 | 10/2012 | Esposito | |
| 8,322,097 | B2 | 12/2012 | Schiffmann et al. | |
| 8,371,556 | B2 | 2/2013 | Price | |
| 8,499,505 | B2 | 8/2013 | Pulte | |
| 8,516,777 | B2 | 8/2013 | Schiffmann et al. | |
| 8,714,887 | B2 | 5/2014 | Tipps et al. | |
| 8,739,489 | B2 | 6/2014 | Weber et al. | |
| 2002/0038684 | A1 * | 4/2002 | Puppin | B29C 47/003 156/88 |
| 2003/0037495 | A1 * | 2/2003 | Shaw | E04F 19/022 52/287.1 |
| 2005/0229531 | A1 * | 10/2005 | Green et al. | 52/736.1 |
| 2005/0284082 | A1 * | 12/2005 | Smith | 52/650.3 |
| 2006/0076545 | A1 | 4/2006 | Reynders et al. | |
| 2007/0151180 | A1 * | 7/2007 | Pace et al. | 52/287.1 |
| 2007/0209316 | A1 * | 9/2007 | Walker | 52/736.1 |
| 2009/0038247 | A1 * | 2/2009 | Taylor | B29C 47/0023 52/287.1 |
| 2009/0056235 | A1 * | 3/2009 | Morsching | 52/58 |
| 2009/0056252 | A1 * | 3/2009 | Taylor et al. | 52/287.1 |
| 2009/0077915 | A1 * | 3/2009 | Haga | 52/288.1 |
| 2012/0241703 | A1 * | 9/2012 | Regan | 256/65.03 |
| 2012/0304568 | A1 * | 12/2012 | Aboukhalil | E04F 19/022 52/309.1 |
| 2012/0328823 | A1 | 12/2012 | Monteer | |
| 2013/0111840 | A1 | 5/2013 | Bordener | |
| 2013/0219824 | A1 * | 8/2013 | Philbin et al. | 52/710 |
| 2014/0054428 | A1 * | 2/2014 | Walker et al. | 248/218.4 |
| 2014/0190092 | A1 * | 7/2014 | Klassen et al. | 52/79.5 |
| 2015/0000219 | A1 * | 1/2015 | Yarmo | E04F 13/0733 52/309.4 |

OTHER PUBLICATIONS

George Schambach, "Durable Details for Vinyl Siding" (Jun. 1997), https://heightslibrary.org/materials/hrrc/20-Siding/VINYL_SIDING_DETAILS.pdf (last visited Jan. 6, 2017).*

* cited by examiner

ENHANCED DECK ASSEMBLY FACILITATION METHODS AND SYSTEMS

RELATED APPLICATIONS

The present application claims benefit of priority of U.S. Prov. App. No. 61/959,379 and U.S. Prov. App. No. 61/959,380 (filed 22 Aug. 2013), both of which were filed within the twelve months preceding the filing date of the present application or is an application of which a currently co-pending application is entitled to the benefit of the filing date.

SUMMARY

Various novel decking systems and methods are presented, each effective for deck assembly facilitation. In one or more various aspects, for example, a decking method includes but is not limited to mounting a deck fascia board to a deck joist and another deck fascia board to a deck rim joist and subsequently mounting a fascia-expansion-accommodation corner covering having a first mounting layer and a second mounting layer and a stress distribution hinge so that the first and second mounting layers each have a mounting surface and a fascia expansion overlap lip and so that the fascia expansion overlap lips each overlap an end of a respective one of the deck fascia boards. In some variants the corner covering may be made of a plastic or composite by molding, extruding, or planing operations. The stress distribution hinge operably couples the first mounting layer to the second mounting layer so that a half-plane adjacent the mounting surface of the first mounting layer and a half-plane adjacent the mounting surface of the second mounting layer are both bounded by a single line along the stress distribution hinge, so that the fascia expansion overlap lip of the first mounting layer is configured to remain against a first of the deck fascia boards (notwithstanding longitudinal expansion or contraction thereof, e.g.), and so that the fascia expansion overlap lip of the second mounting layer is configured to remain against a second of the deck fascia boards. In addition to the foregoing, other method aspects are described in the claims, drawings, and text forming a part of the disclosure set forth herein.

An embodiment provides a decking system. In one implementation, the decking system includes but is not limited to a fascia-expansion-accommodation corner covering having a first mounting layer and a second mounting layer and a stress distribution hinge, the first and second mounting layers each having a mounting surface and a fascia expansion overlap lip, the stress distribution hinge operably coupling the first mounting layer to the second mounting layer so that a half-plane adjacent the mounting surface of the first mounting layer and a half-plane adjacent the mounting surface of the second mounting layer are both bounded by a single line along the stress distribution hinge and so that the fascia expansion overlap lip of the first mounting layer is configured to remain against a first deck fascia board notwithstanding a longitudinal expansion of the first deck fascia board and so that the fascia expansion overlap lip of the second mounting layer is configured to remain against a second deck fascia board notwithstanding a longitudinal expansion of the second deck fascia board.

Some variants comprise a railpost support that includes a baseplate and a plurality of flexible finger mounts and a sleeve section, optionally made from sheet metal that is laser cut or stamped and punched and bent. One or more tensile elements (screws, e.g.) are configured to hold the baseplate removably in rigid engagement (metal-to-metal contact, e.g.) with at least a threaded portion of a railpost support interface. This can occur, for example, in a context in which one or more top surfaces of the railpost support interface are roughly even with (nominally flush with or within a few centimeters higher than) a walking surface of the deck (when adjacent decking boards are applied, e.g.) and in which the sleeve section is supported by the baseplate and supports the flexible finger mounts in contact with a railpost inserted into the sleeve section.

In addition to the foregoing, various other method and/or system and/or program product aspects are set forth and described in the teachings such as text (e.g., claims and/or detailed description) and/or drawings of the present disclosure. The foregoing is a summary and thus may contain simplifications, generalizations, inclusions, and/or omissions of detail; consequently, those skilled in the art (professional or do-it-yourself deck builders, e.g.) will appreciate that the summary is illustrative only and is NOT intended to be in any way limiting. Other aspects, features, and advantages of the devices and/or processes and/or other subject matter described herein will become apparent by reference to the detailed description, the corresponding drawings, and/or in the teachings set forth herein.

DETAILED DESCRIPTION

For a more complete understanding of embodiments, reference now is made to the following descriptions taken in connection with the accompanying drawings. The use of the same symbols in different drawings typically indicates similar or identical items, unless context dictates otherwise. The illustrative embodiments described in the detailed description, drawings, and claims are not meant to be limiting. Other embodiments may be utilized, and other changes may be made, without departing from the spirit or scope of the subject matter presented here.

In light of teachings herein, numerous existing techniques may be applied for implementing decking components with materials appropriate for achieving the significantly improved accommodation of thermal and assembly variations as described herein without undue experimentation. See, e.g., U.S. Pat. No. 8,739,489 ("Decking system"); U.S. Pat. No. 8,714,887 ("Fascia counter-bore bit and fascia screw"); U.S. Pat. No. 8,516,777 ("Method of fabricating building wall panels"); U.S. Pat. No. 8,499,505 ("Pultruded trim members"); U.S. Pat. No. 8,371,556 ("Multi-function deck tool"); U.S. Pat. No. 8,322,097 ("Methods of constructing buildings and building appurtenances"); U.S. Pat. No. 8,291,647 ("Self-contained structure configurable as a shipping container and as a dwelling"); U.S. Pat. No. 8,272,190 ("Method of fabricating building wall panels"); U.S. Pat. No. 8,256,614 ("Interconnected and on-site severable deck clips with cooperating installation tool for joining two adjacent decking planks to an underlying support structure"); U.S. Pat. No. 8,091,500 ("Over-the-water dock"); U.S. Pat. No. 7,926,226 ("Deployable prefabricated structure with an extension structure that is sealable to the prefabricated structure upon deployment from the prefabricated structure"); U.S. Pat. No. 7,908,812 ("Decking system and anchoring device"); U.S. Pat. Pub. No. 2013/0111840 ("Kit and assembly for compensating for coefficients of thermal expansion of decoratively mounted panels"); U.S. Pat. Pub. No. 2012/0328823 ("Trim components for lapboard siding that are co-extruded from wood-plastic composites and polyvinyl chloride"); and U.S. Pat. Pub. No. 2006/0076545 ("Railing assemblies and related methods and apparatuses").

Figure 1:
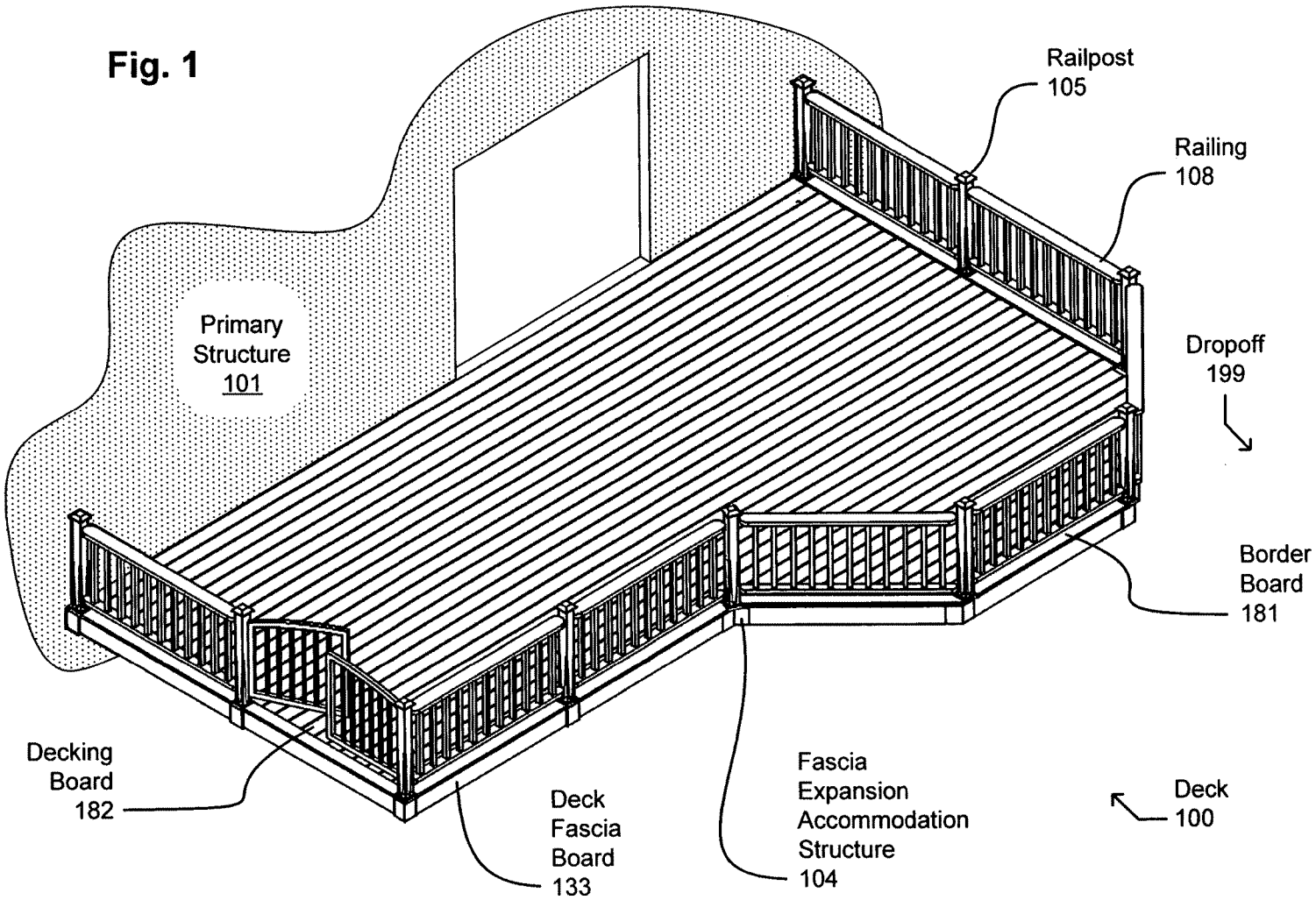
FIG. 1 depicts a deck mounted onto a primary structure (a house or commercial building, e.g.).

FIG. 1 depicts a context in which one or more technologies may be implemented. An unconventional deck 100 is mounted onto a primary structure 101 (a house or commercial building, e.g.) and adjoining a stairway (not shown). Deck 100 comprises several decking boards 182 laid across deck joists as shown and described below. Deck fascia boards 133 and border boards 181 cover portions of the deck joists and deck rim joists around the perimeter of the deck 100 as shown and described below. Various fascia expansion accommodation structures 104 allow for longitudinal variation (of the deck fascia boards 133, e.g.) as shown and described below. Moreover a railing 108 comprises several removable railposts 105 that facilitate deck assembly while providing extra safety for occupants of deck 100 (from a dropoff 199, e.g.), especially in a context in which a railpost 105 is not in direct contact with a joist. See FIGS. 3-9. Those skilled in the art will recognize that the systems and methods described below advance the state of the art significantly (in comparison with existing deck structures and techniques, e.g.) in terms of both quality and cost-effectiveness.

Figure 2:
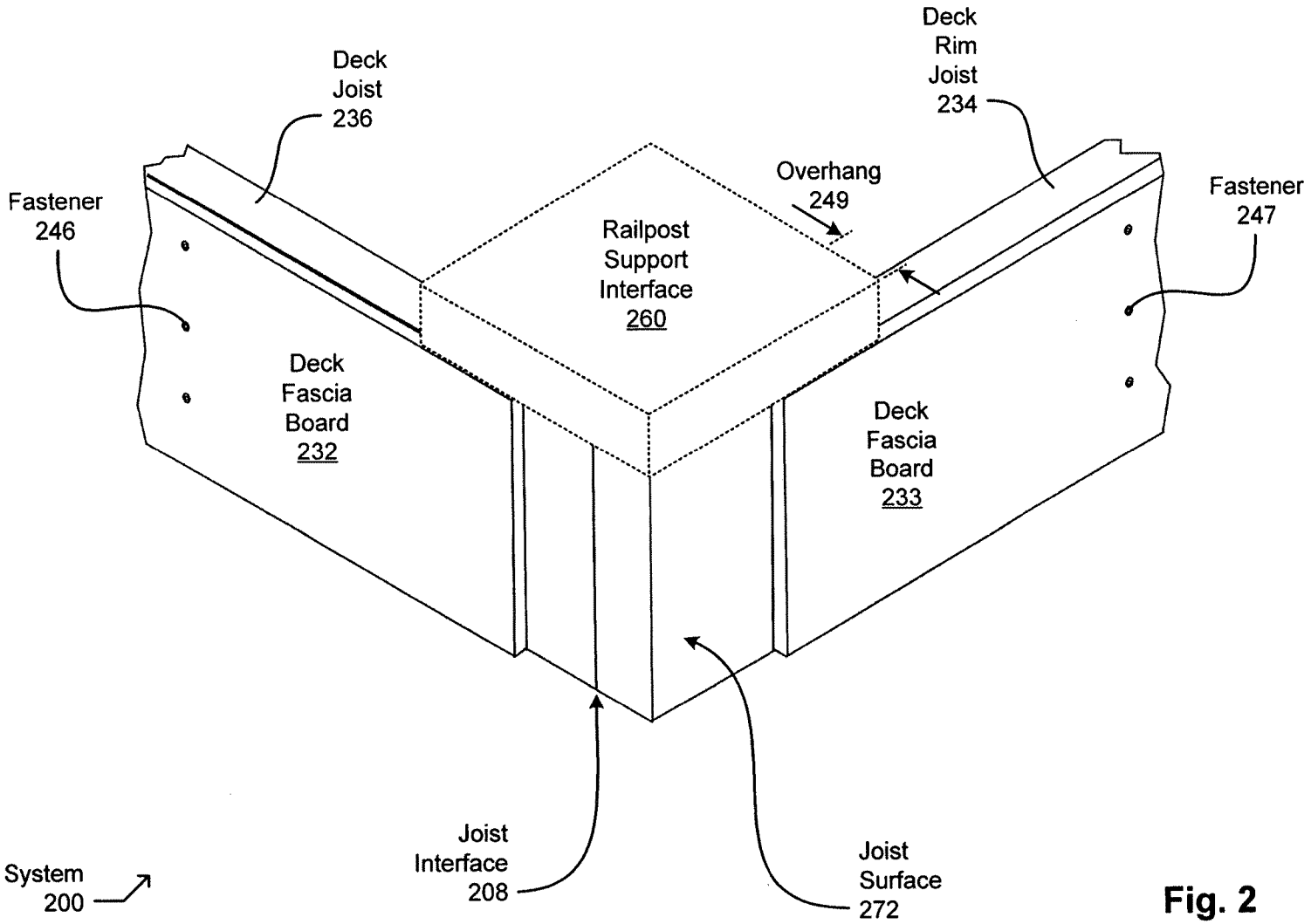
FIG. 2 depicts a decking system comprising joists and fascia boards in relation to a railpost support interface.

FIG. 2 depicts a context in which one or more technologies may be implemented. Decking system 200 optionally implements particular aspects of deck 100 (in a variant in which deck fascia board 233 instantiates deck fascia board 133, e.g.). Deck rim joist 234 optionally covers an end of deck joist 236 at a joist interface 208 as shown. Several fasteners 247 mount deck fascia board 233 directly on a joist surface 272 of deck rim joist 234 and other fasteners 246 permit deck fascia board 232 to be supported directly or indirectly by deck joist 236. A railpost support interface 260 is mounted alongside or over deck rim joist 234 and optionally alongside and over deck joist 236 (by an overhang 249 of one or more centimeters, e.g.) by any of several support structures, such as those described in detail below. A rigid railpost support interface 260 (constructed of aluminum or a similarly stiff material, e.g.) is used for mounting a railpost support to one or more joists rather than relying upon a railpost that supports the weight of the deck (extending vertically to the ground or diagonally to a primary structure, e.g.) without a railpost 105 thereof coming into direct contact with the joist. Also as shown one or more deck fascia boards 232, 233 are cut short (by one or more centimeters, e.g.), leaving an end most portion of a joist surface 272 of one or more perimeter joists (a deck rim joist or deck joist along a deck perimeter, e.g.) partly exposed at the time of initial deck assembly.

Figure 3:
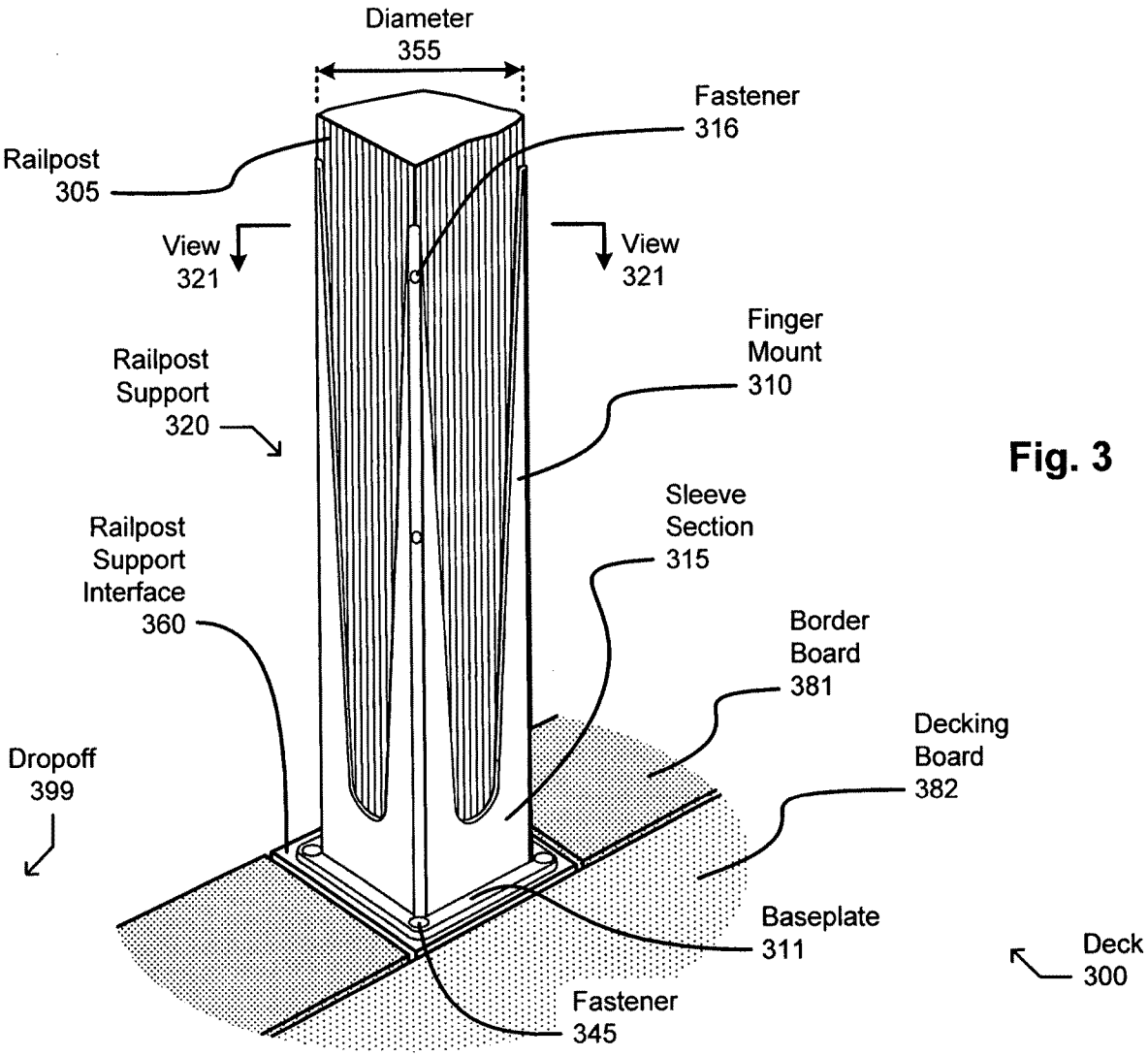
FIG. 3 depicts a railpost in relation to railpost support and boards of a deck.

FIG. 3 depicts another context in which one or more technologies may be implemented. As shown, railpost support 320 includes a sleeve section 315 supporting a plurality of flexible finger mounts 310 and mounted on a baseplate 311. (See FIG. 4 for a top-down view 321 of this structure.) Also as shown, deck 300 has been assembled in an atypical and significantly advantageous sequence made possible by its novel structure. The several fasteners 345 that rigidly engage railpost support 320 to railpost support interface 360 (optionally with metal-to-metal contact therebetween, e.g.) have been installed after some or all border boards 381 or decking boards 382 of deck 300 adjacent railpost support 320 have been fastened onto their respective joists (deck rim joist 234 or deck joist 236, e.g.). This can occur in a variant in which railpost 305 instantiates railpost 105, for example, or in which railpost support interface 360 instantiates railpost support interface 260. Moreover in one or more optional aspects, railpost support 320 may comprise a composite or wooden railpost 305 having a diameter 355 of 5 to 20 centimeters, the railpost extending (downward, e.g.) into a gap among a plurality of flexible finger mounts 310 (each 5 to 50 centimeters in length and engaging railpost 305 with a plurality of fasteners 316, e.g.) of the railpost support 320. Such assembly methods (incorporating such a railpost support 320 rigidly attached in this way, e.g.) permit a railing to be made safe even at a site in which an adjacent dropoff 399 is substantial (exceeding 3 meters, e.g.), as further described below.

Figure 4:
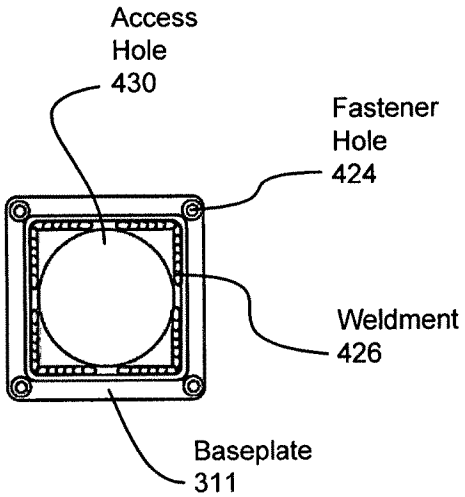
FIG. 4 depicts a bottom view of the railpost support of FIG. 3.

FIG. 4 depicts a top view 321 of a primary component of the railpost support 320 depicted in FIG. 3. As shown baseplate 311 is a rounded square layer (of aluminum or other suitable metal, e.g.) having one or more access holes 430 therein totaling more than 10% of its area and welded (by an annular arrangement of one or more weldments 426, e.g.) to sleeve section 315. Moreover a fastener hole 424 at each of several corners facilitates the mounting of baseplate 311 onto railpost support interface 360 (before or after sleeve section 315 receives railpost 305, e.g.). In some variants this can occur after the installation of one or more border boards 381 or decking boards 382 adjacent railpost support interface 360, facilitating assembly. In this way a plurality of such fasteners (screws or other tensile elements configured to extend downward through the baseplate 311 into a threaded portion of the railpost support interface 360, e.g.) may be configured to hold the baseplate 311 removably in rigid engagement with (an instance of) a railpost support interface 360 built into deck 300. This can occur, for example, in a context in which a top surface of the railpost support interface 360 is nominally flush with a top of the decking boards 382; in which the sleeve section 315 is configured to be supported by the baseplate 311 and to support the flexible finger mounts 310 in contact with a railpost 305 inserted (nominally vertically, e.g.) into the sleeve section 315.

Figure 5:
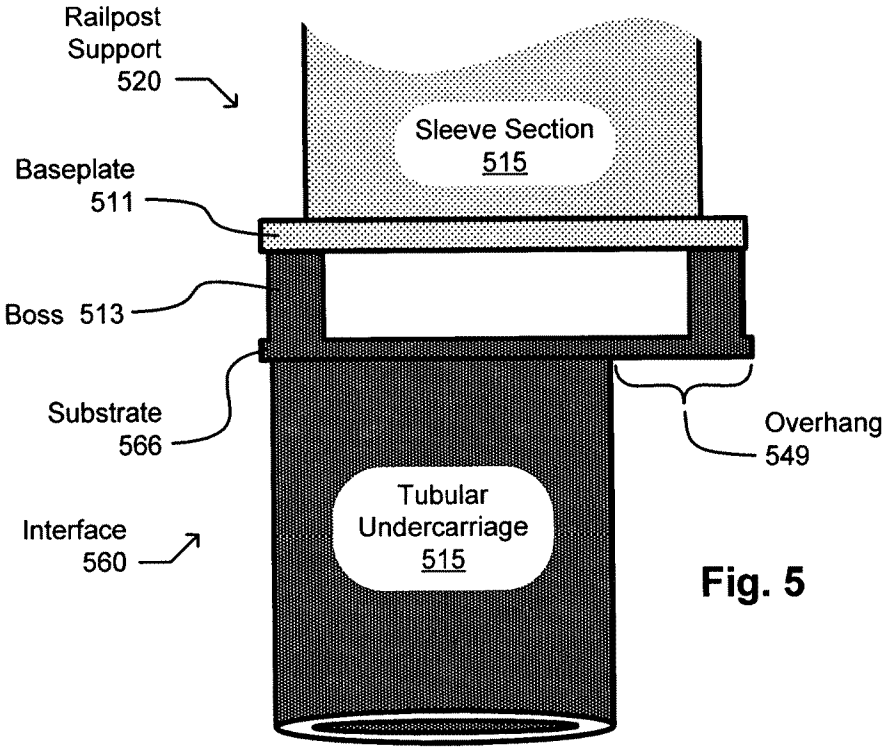
FIG. 5 depicts a railpost support engaging a railpost support interface.

FIG. 5 depicts another context in which one or more technologies may be implemented, showing specifics of how a railpost support 520 (having a baseplate 511 and sleeve section 515 generally like those of the railpost support 320 of FIG. 3, e.g.) may be rigidly and removably supported by a railpost support interface 560 (generally like the railpost support interfaces 260, 360 depicted in FIGS. 2 & 3, e.g.). In the variant of FIG. 5, the railpost support interface 560 (depicted in a darker pattern) provides such rigid support by several bosses 513 (four or more, e.g.) integrally formed or otherwise mounted onto a substrate 566 (at its periphery as shown, e.g.). A tubular undercarriage 515 or similar rigid support is affixed to one or more joists (deck rim joist 234 or deck joist 236, e.g.) over which a portion of substrate 566 overhangs. Such overhang 549 may have a length of 3 to 15 centimeters, for example.

Figure 6:
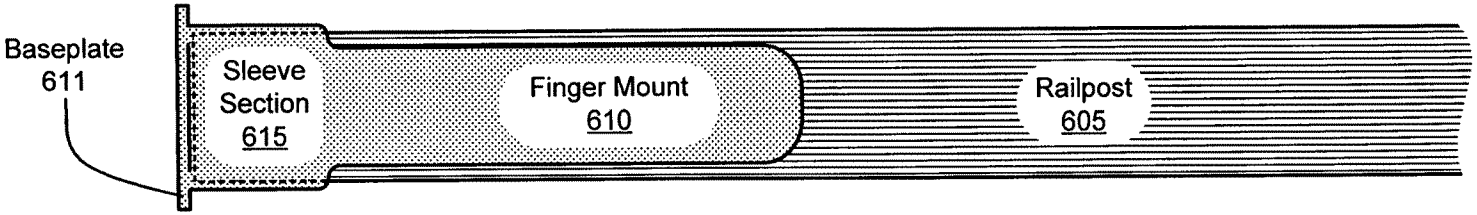
FIG. 6 depicts a railpost inserted into a railpost support before engaging with a railpost support interface.

FIG. 6 depicts another context in which one or more technologies may be implemented, showing specifics of how another system 600 incorporating railpost support 520 may be constructed and arranged. As shown there, railpost support 520 may optionally include a baseplate 611 and a pair of flexible finger mounts 610 and a sleeve section 615 therebetween, with railpost 605 being installed between finger mounts 610 and into sleeve section 615 before being mounted onto a railpost support interface 260. In some contexts, this permits a factory assembly of railpost 605 into railpost support 520, with an adhesive sealant in addition to or in lieu of fasteners affixing finger mount 610 into (opposite sides of) railpost 605. In some contexts, for example, hot glue may be used for such assembly at all surfaces where railpost 605 is adjacent finger mount 610 or sleeve section 615, reducing the vulnerability of the railpost 605 to water-induced deterioration.

Figure 7:
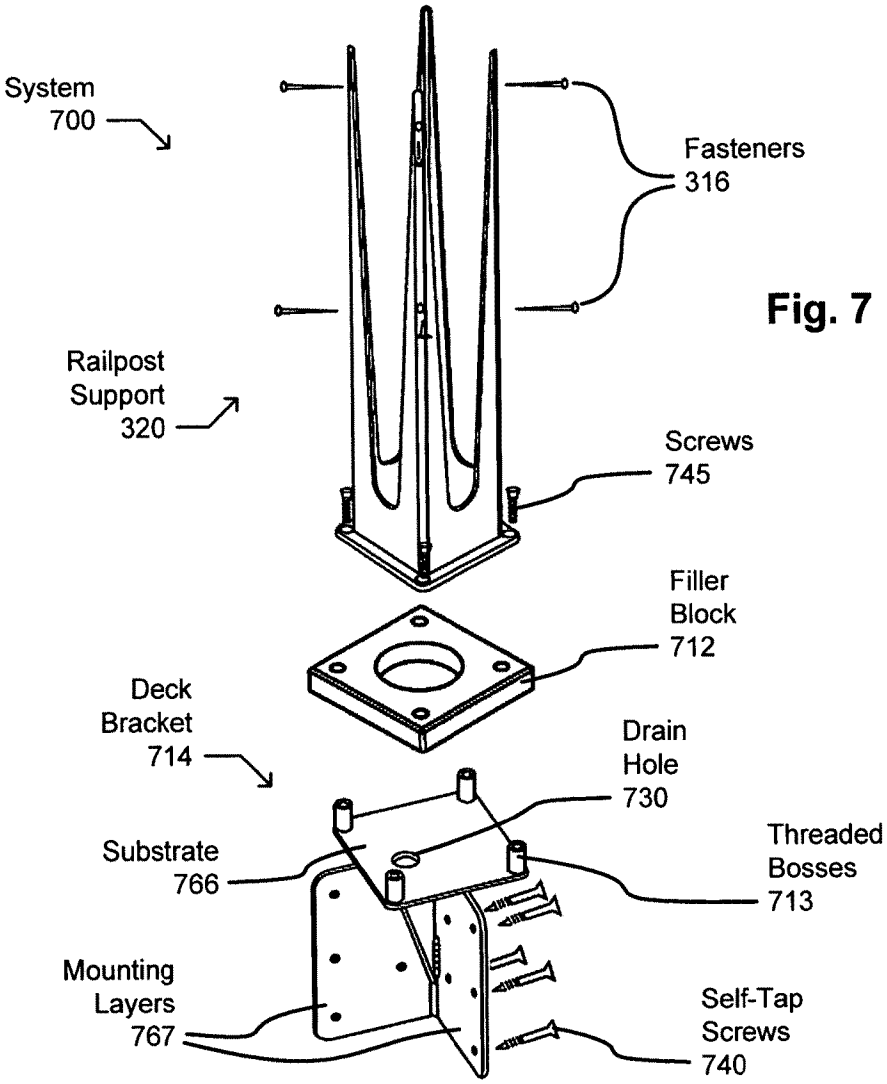
FIG. 7 depicts an oblique view of a railpost support in relation to a deck bracket of a railpost support interface.

FIG. 7 depicts another context in which one or more technologies may be implemented, a system 700 for implementing several optional features in the deck 300 of FIG. 3. As shown in FIG. 3, railpost support 320 includes a baseplate 311 and several flexible finger mounts 710 each tapered (to become steadily narrower along a majority of its length, e.g.) to become progressively more flexible (tolerant of lateral bending, e.g.) at several places along its length but still thick enough (having a diameter of about 1 millimeter or more for a majority of its length, e.g.) to resist longitudinal stretching or compression. As shown, fasteners 316 are implemented as screws (1-5 centimeters in length, e.g.) that self-tap into respective corners of railpost 305. Railpost support interface 360 is implemented, in the variant of FIG. 7, as a rigid deck bracket 714 (implemented in galvanized steel, aluminum, or a similar or more rigid material, e.g.) with an aesthetic covering (i.e. filler block 712). Deck bracket 714 (optionally painted, galvanized, or anodized) comprises several threaded bosses 713 mounted on a rigid substrate 766 (with a drain hole 730 as shown, e.g.) resembling the substrate 566 of FIG. 5, but welded onto two mounting layers that are welded together (one being mountable to one deck joist and other being mountable to a deck rim joist with self-tap screws 740, e.g.). Screws 745 that pass through baseplate 311 are configured with threading to match that of corresponding threaded bosses 713 of the deck bracket 714 as shown. In some variants, filler block 712 and substrate 766 have a combined thickness nominally equal to that of border board 381 and decking board 382 as shown in FIG. 3.

Figure 8:
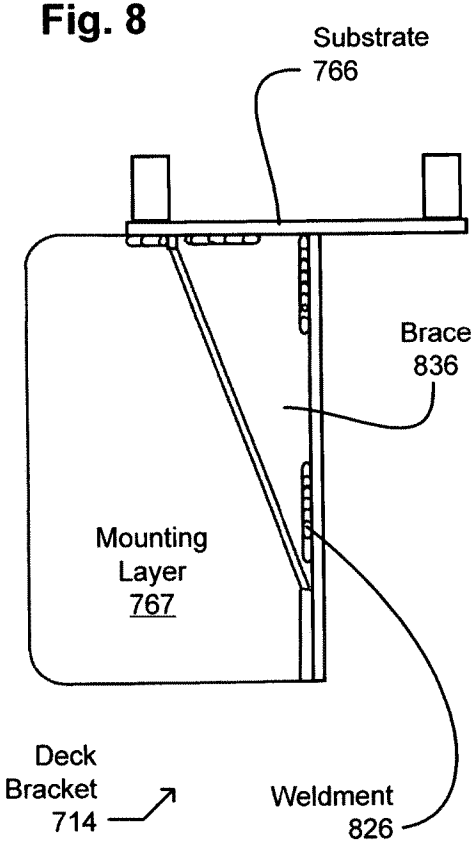
FIG. 8 depicts a side view of the deck bracket of FIG. 7.

FIG. 8 depicts a side view of deck bracket 714, showing further specifics about how weldments 826 may be used to attach the one or more mounting layers 767 thereof to substrate 766 and to deck bracket brace 836.

Figure 9:
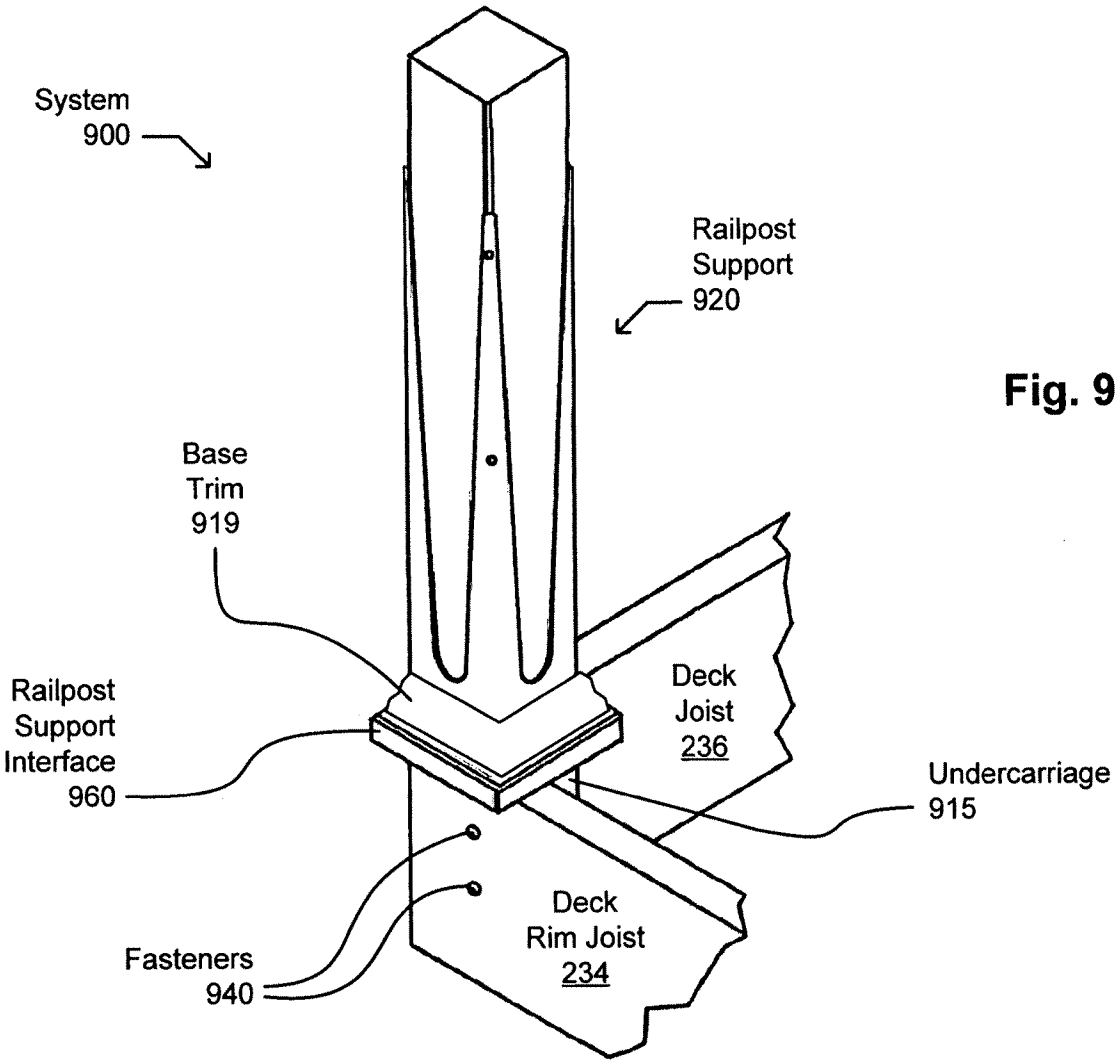
FIG. 9 depicts a railpost support engaging a railpost support interface in relation to two joists of a decking system.

FIG. 9 depicts another context in which one or more technologies may be implemented. A railpost support interface 960 is firmly mounted onto undercarriage 915, which optionally implements tubular undercarriage 515, deck bracket 714, or other such suitable structures for rigid mounting onto one or both joists as shown (i.e. each with a plurality of fasteners 940). Thereafter, atypically, railpost support 920 (implementing one of the railpost supports 320, 520 described above, e.g.) has been installed onto railpost support interface 960 and annular base trim 919 has been installed (around the sleeve section and over the baseplate and fasteners, e.g.) before and border boards 181 or decking boards 182 are installed onto the joists. This configuration is useful for clarity of illustration or to confirm dimensional appropriateness but is generally not as efficient (for production installation, e.g.) as methods described herein in which other deck components (decking boards 182, 382 and deck fascia boards 133, e.g.) have been installed before railpost support 920.

Figure 10:
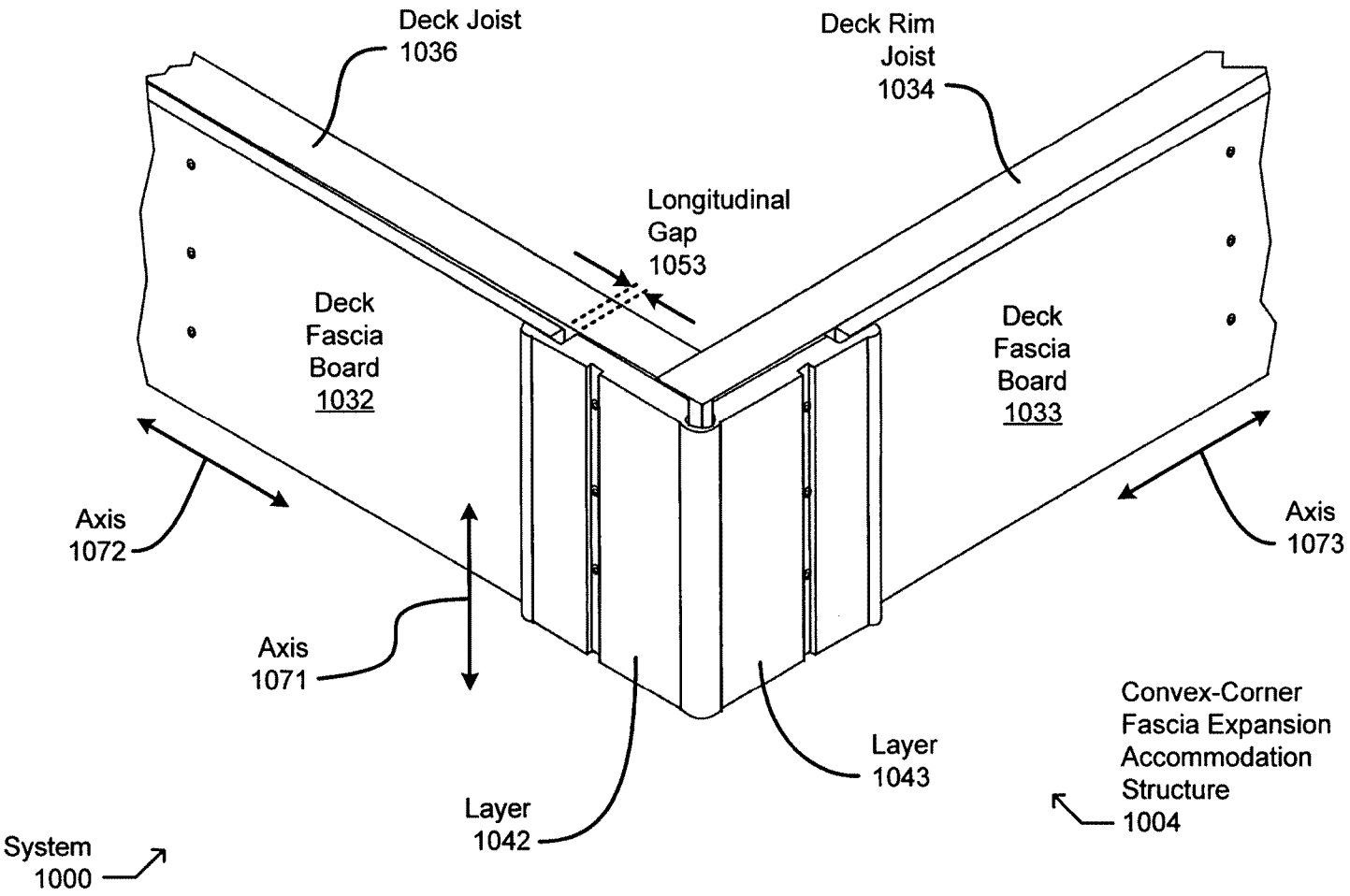
FIG. 10 depicts deck fascia boards and a fascia expansion accommodation structure in relation to two joists of a decking system.

FIG. 10 depicts another context in which one or more technologies may be implemented. A system 1000 comprises a convex-corner fascia expansion accommodation structure 1004 covering a 90° corner of a deck 100, 300 as described above. This can occur, for example, in a context in which deck fascia board 1033 instantiates deck fascia board 133 or in which border board 381 will soon be mounted over deck rim joist 1034 or deck joist 1036. The fascia expansion accommodation structure 1004 has a first mounting layer 1042 and a second mounting layer 1043 and hinge operably coupling the mounting layers 1042, 1043 so that a half-plane adjacent the mounting surface of the first mounting layer and a half-plane adjacent the mounting surface of the second mounting layer are both bounded by a single line (nominally parallel to vertical axis 1071, e.g.) along the hinge, as further described below. Deck fascia board 1032 and mounting layer 1042 are each mounted onto deck joist 1036 with a longitudinal gap 1053 therebetween (i.e. along a longitudinal axis 1072). Mounting layer 1042 has a fascia expansion overlap lip extending (leftward as shown) over (a front of) this longitudinal gap 1053 so that (part of) the lip remains laterally adjacent deck fascia board 1032 irrespective of a longitudinal expansion of or contraction of deck fascia board 1032. Likewise deck fascia board 1033 and mounting layer 1043 are each mounted onto deck rim joist 1034 with a longitudinal gap therebetween, along a longitudinal axis 1073 corresponding to deck fascia board 1033. Mounting layer 1043 likewise has a fascia expansion overlap lip extending (rightward as shown) over this latter longitudinal gap so that (part of) the lip remains laterally adjacent deck fascia board 1033 irrespective of a longitudinal expansion of or contraction of deck fascia board 1033.

Figure 11:
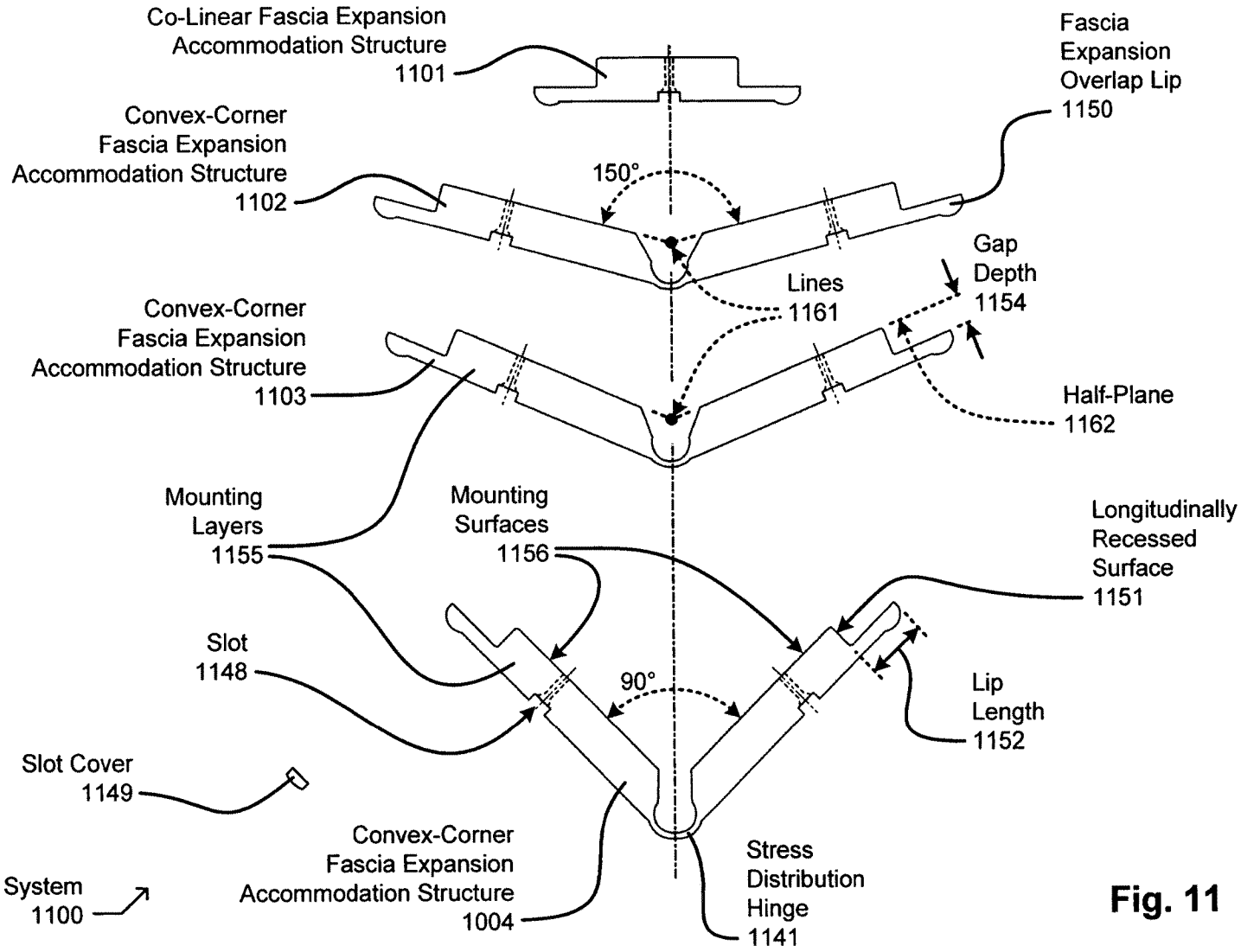
FIG. 11 depicts several fascia expansion accommodation structures.

FIG. 11 depicts another context in which one or more technologies may be implemented, including a top view of the convex-corner fascia expansion accommodation structure 1004 of FIG. 10. Insofar that stress distribution hinge 1141 is several centimeters in length (along axis 1071, e.g.) and curved and somewhat more pliable than the structures it couples (by virtue of being 0.5 to 5 millimeters in thickness, e.g.), this structure provides sufficient rigidity and strength and is effective for preventing hinge damage by distributing structural tension laterally (orthogonal to vertical axis 1071, e.g.) across a width of about a millimeter or more in response even to a significant hinging stress (deviating from a nominal angle by 1-5 degrees, e.g.) when the hinge is made of a suitable material (a vinyl or similar composite, e.g.). Convex-corner fascia expansion accommodation structure 1004 likewise includes first and second mounting layers 1155 that each include a mounting surface 1156 and a fascia expansion overlap lip 1150. The stress distribution hinge 1141 operably couples the first mounting layer to the second mounting layer so that a half-plane 1162 adjacent the mounting surface of the first mounting layer and a half-plane adjacent the mounting surface of the second mounting layer are both bounded by a single line 1161 along the stress distribution hinge and so that the fascia expansion overlap lip 1150 of the first mounting layer 1155 is configured to remain laterally adjacent a first deck fascia board irrespective of a longitudinal expansion of or contraction of the first deck fascia board and so that the fascia expansion overlap lip of the second mounting layer is configured to remain laterally adjacent a second deck fascia board irrespective of a longitudinal expansion of or contraction of the second deck fascia board.

Those skilled in the art will recognize that some list items may also function as other list items. Each such listed term should not be narrowed by any implication from other terms in the same list but should instead be understood in its broadest reasonable interpretation as understood by those skilled in the art.

"Adhesed," "adjacent," "affixed," "along," "arranged," "at least," "at most," "constructed," "covering," "first," "from," "further," "integrally," "irrespective," "longitudinal," "metallic," "mounting," "nominal," "of," "overlapping," "recessed," "remaining laterally adjacent," "sealed," "single," "spanning," "supporting," "vertical," "welded," "toward," or other such descriptors herein are used in their normal yes-or-no sense, not as terms of degree, unless context dictates otherwise. "To" is not used to articulate a mere intended purpose in phrases like "configured to," moreover, but is used normally, in descriptively identifying a particular device or pattern that is actually performing or implementing a task or arrangement or to a structure that can serve this function without significant modification. "Substantially" is used herein (in relation to approximately ideal or aligned entities, e.g.) to refer to having a difference or deviation of at most about 2° or 2% or 2 millimeters, unless context dictates otherwise. Positional relation terms like "along" or "adjacent" are used herein to refer to nominal (substantially ideal, e.g.) relations, having a difference or deviation of at most about 2° or 2% or 2 millimeters, unless context dictates otherwise.

In some variants of convex-corner fascia expansion accommodation structure 1004, the half-plane 1162 adjacent the mounting surface 1156 of the first mounting layer 1155 and the half-plane 1162 adjacent the mounting surface 1156 of the second mounting layer 1155 form a nominal right angle configured to span both a joist (deck joist 236, e.g.) that supports the first deck fascia board 232 and a joist (deck rim joist 234, e.g.) that supports the second deck fascia board 233. Insofar that this nominal angle is less than 180°, the fascia-expansion-accommodation corner covering may be described as a "convex-corner" fascia expansion accommodation structure. Moreover the fascia expansion overlap lips as shown may (optionally) each have a nominal lip length 1152 of at least about 2 millimeters or at most about 2 centimeters. Also as shown the gap depth 1154 created by longitudinally recessed surface 1151 behind the lip may likewise be at least about 2 millimeters (at least about equal to a thickness of the first deck fascia board, e.g.) or at most about 2 centimeters. Moreover the thicker portion of the mounting layers 1155 of FIG. 11 (thicker than the respective fascia expansion overlap lips, e.g.) may be about 3 millimeters or more thick, so that they can accommodate a fastener slot 1148 in each mounting surface thereof that can receive fasteners that are later covered by slot cover 1149, as shown.

FIG. 11 also depicts a co-linear fascia expansion accommodation structure 1101 (not configured to accommodate a corner, e.g.). Also depicted are convex-corner fascia expansion accommodation structures 1102, 1103 in which the respective (instance of) half-plane 1162 adjacent the mounting surface 1156 of the first mounting layer 1155 and the respective half-plane 1162 adjacent the mounting surface 1156 of the second mounting layer 1155 form an obtuse angle (nominally equal to 135° or 150°, e.g.) spanning two joists that come together at an angle as shown in several instances described herein, such fascia-expansion-accommodation corner coverings each being an example of a "convex-corner" fascia expansion accommodation structure.

Figure 12:
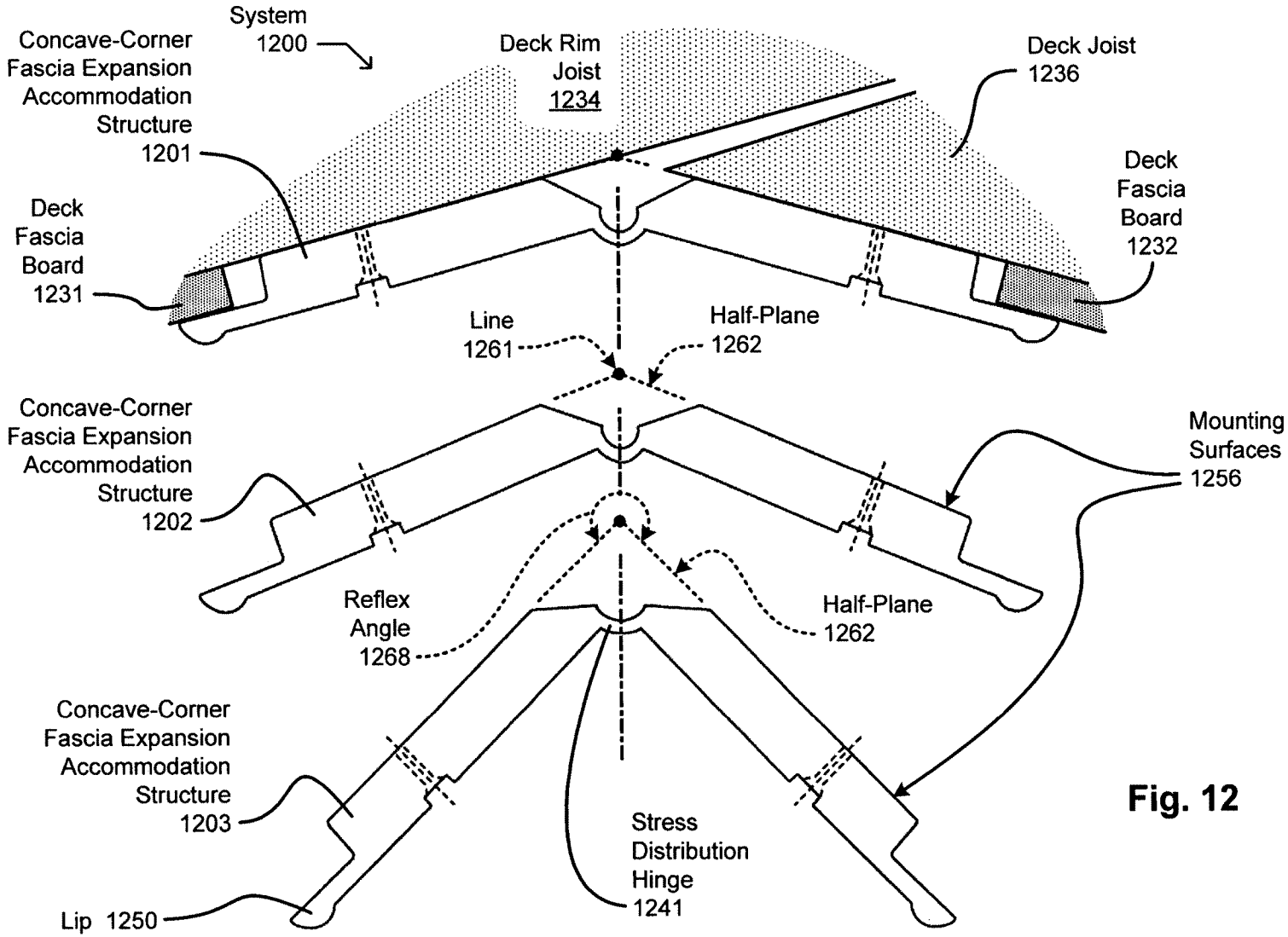
FIG. 12 depicts several additional fascia expansion accommodation structures.

FIG. 12 depicts another context in which one or more technologies may be implemented, a decking system 1200 depicted as (a top view of) three concave-corner fascia expansion accommodation structures 1201, 1202, 1203 (having respective nominal reflex angles 1268 of 210°, 225°, and 270° as shown). Each of these structures is a corner covering having first and second mounting layers 1155 and a stress distribution hinge 1241 therebetween, the layers each having a mounting surface 1256 and a fascia expansion overlap lip 1250 configured so that the stress distribution hinge 1241 operably couples the layers and so that a half-plane 1262 adjacent the mounting surface 1256 of the first mounting layer 1155 and a half-plane 1262 adjacent the mounting surface 1256 of the second mounting layer 1155 are both bounded by a single line 1261 (perpendicular to the page of FIG. 12 and thus depicted as a dot in FIG. 12) along the stress distribution hinge 1241 and so that the fascia expansion overlap lip 1250 of the first mounting layer is configured to remain laterally adjacent a first deck fascia board 1231 irrespective of a longitudinal expansion of or contraction of the first deck fascia board 1231 as shown (when deck fascia board 1232 is mounted on its corresponding joist, deck rim joist 1234. Likewise the fascia expansion overlap lip of the second mounting layer 1155 is configured to remain laterally adjacent a second deck fascia board 1232 (mounted onto deck joist 1236, e.g.) irrespective of a longitudinal expansion of or contraction of the second deck fascia board 1232.

Figure 13:
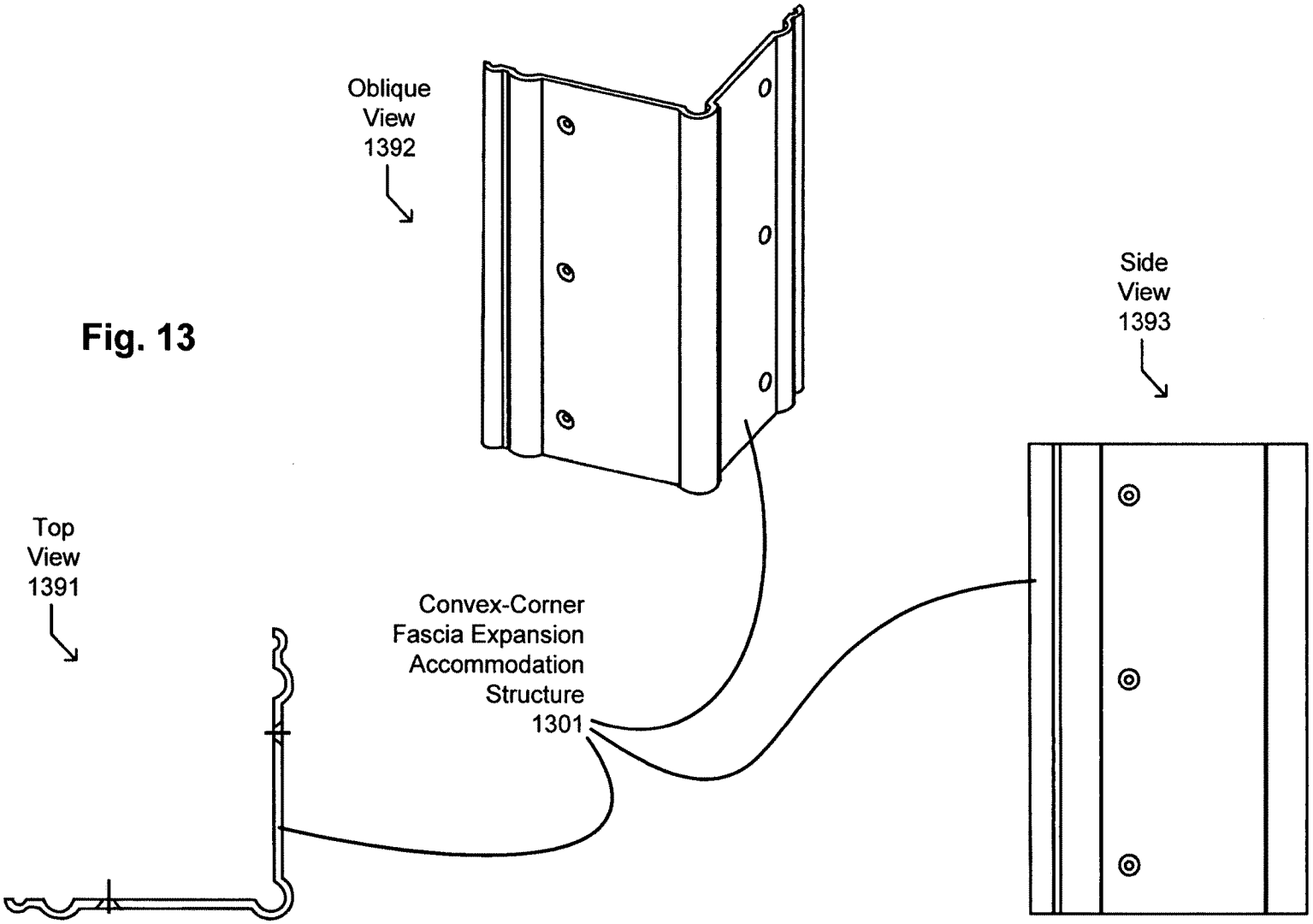
FIG. 13 depicts several views of an additional fascia expansion accommodation structure.
Figure 14:
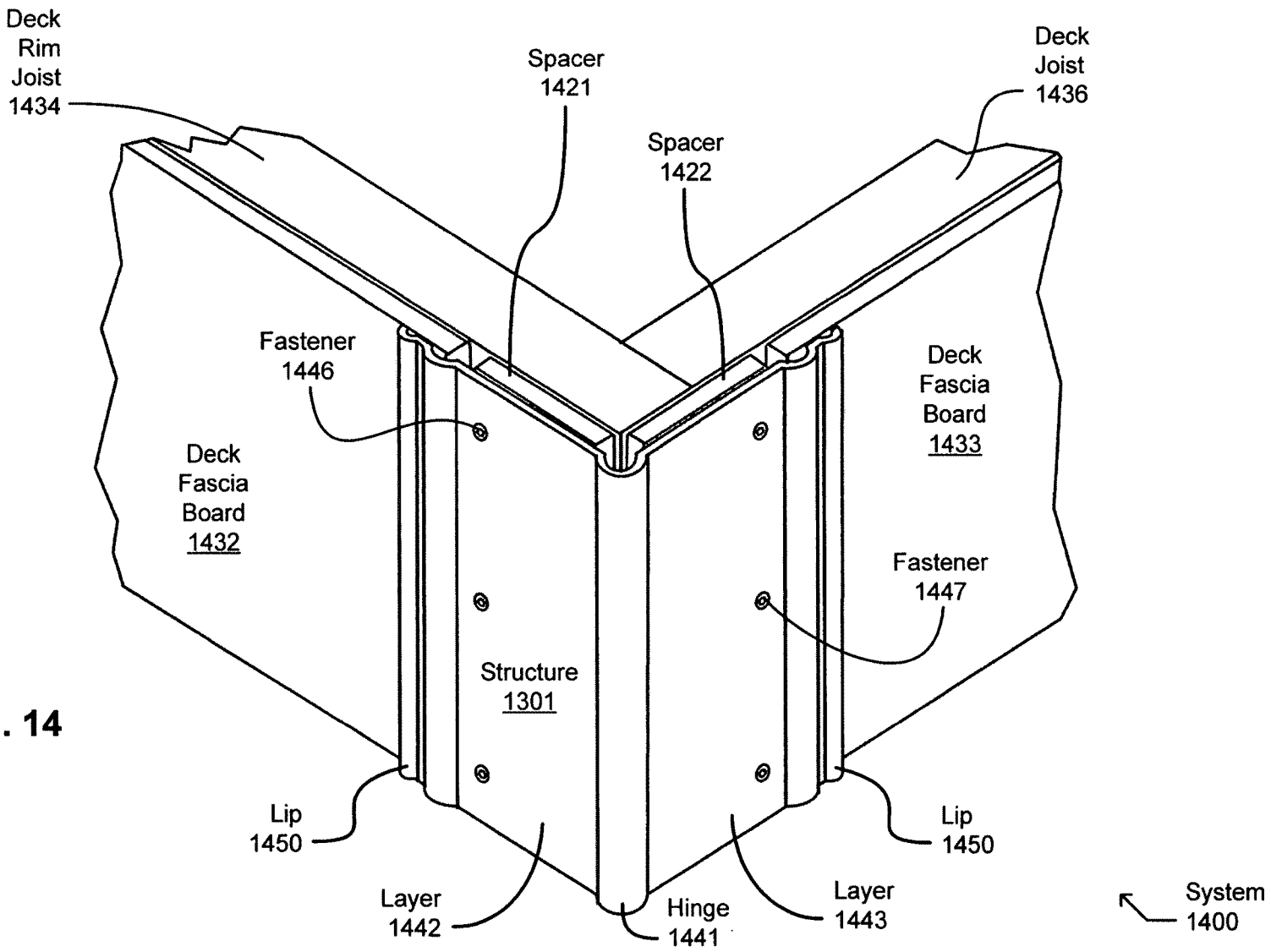
FIG. 14 depicts a decking system that incorporates the fascia expansion accommodation structure of FIG. 13.

FIG. 13 depicts another context in which one or more technologies may be implemented, a top view 1391 and oblique view 1392, and side view 1393 of a convex-corner fascia expansion accommodation structure 1301 that can be used in various covering configurations. FIG. 14 depicts one such configuration, a decking system 1400 comprising an assembly that includes the convex-corner fascia expansion accommodation structure 1301 assembled according to a method embodiment in which that assembly includes completing a corner assembly before the installation of a railpost support interface 260 (in replacing a rotted interface or component thereof, e.g.). The corner covering of FIG. 14 comprises a plurality of mounting layers 1442, 1443 and a stress distribution hinge 1441 therebetween as shown. Mounting layer 1442 includes a fascia expansion overlap lip 1450 and a spacer 1421 (optionally made of the same material as deck fascia board 1432, e.g.) that has a mounting surface 1156 in contact with deck rim joist 1434, constructed and arranged so that the fascia expansion overlap lip 1450 of the first mounting layer 1442 remains laterally adjacent deck fascia board 1432 irrespective of a longitudinal expansion of or contraction of the first deck fascia board. Likewise mounting layer 1443 includes a fascia expansion overlap lip 1450 and a spacer 1422 that has a mounting surface in contact with deck joist 1436, constructed and arranged so that the fascia expansion overlap lip 1450 of the second mounting layer 1443 remains laterally adjacent the second deck fascia board 1433 irrespective of a longitudinal expansion of or contraction of the second deck fascia board 1433 (by providing a longitudinal gap 1053 behind that lip of at least about 0.5 millimeters and at most about 5 millimeters, e.g.).

Figure 15:
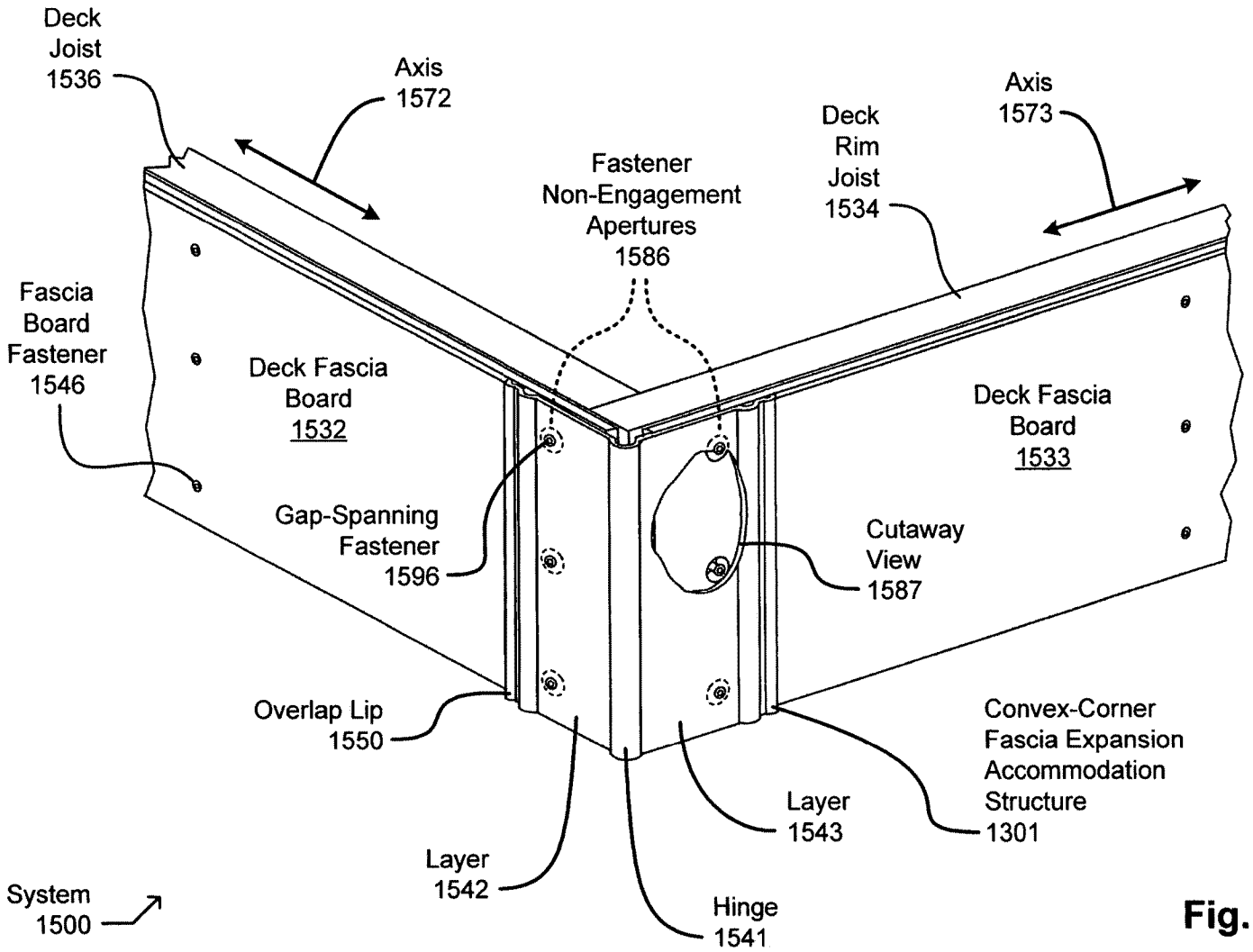
FIG. 15 depicts another decking system that incorporates the fascia expansion accommodation structure of FIG. 13.

FIG. 15 depicts another decking system 1500 that includes the convex-corner fascia expansion accommodation structure 1301 of FIG. 13. The fascia-expansion-accommodation corner covering of FIG. 15 comprises a plurality of mounting layers 1542, 1543 and a stress distribution hinge 1541 therebetween as shown, the mounting layers 1542, 1543 each including a fascia expansion overlap lip 1550. Moreover a contiguous deck fascia board 1532 is configured to support layer 1542 (in lieu of spacer 1421 and in lieu of a greatly thickened portion like those depicted in FIGS. 11 & 12, e.g.). This is feasible, in the system 1500 of FIG. 15, by virtue of one or more fastener non-engagement apertures 1586 in deck fascia board 1532 long enough to permit horizontal slippage of an endmost portion of fascia board 1532 (more than one millimeter in length along axis 1572, e.g.) without deck fascia board 1532 directly pushing or pulling on the gap-spanning fasteners 1596 that support layer 1542 (relative to deck joist 1536, e.g.) longitudinally along axis 1572. Likewise one or more fastener non-engagement apertures 1586 (visible in cutaway view 1587, e.g.) long enough to permit horizontal slippage of an endmost portion of fascia board 1533 (more than one millimeter in length along axis 1573, e.g.) without deck fascia board 1532 directly causing a longitudinal dislocation of the fasteners 1596 that support layer 1543 (relative to deck rim joist 1534, e.g.). As shown deck fascia board 1532 is affixed tightly to deck joist 1536 by one or more fascia board fasteners 1546. Likewise deck fascia board 1533 is affixed tightly to deck rim joist 1534 by one or more fascia board fasteners 1546. Also deck fascia boards 1532, 1533 each have one or more fastener non-engagement apertures 1586 through which one or more gap-spanning fasteners 1596 that support the fascia-expansion-accommodation corner covering pass (slidably engaging or not engaging the respective deck fascia boards 1532, 1533).

Figure 16:
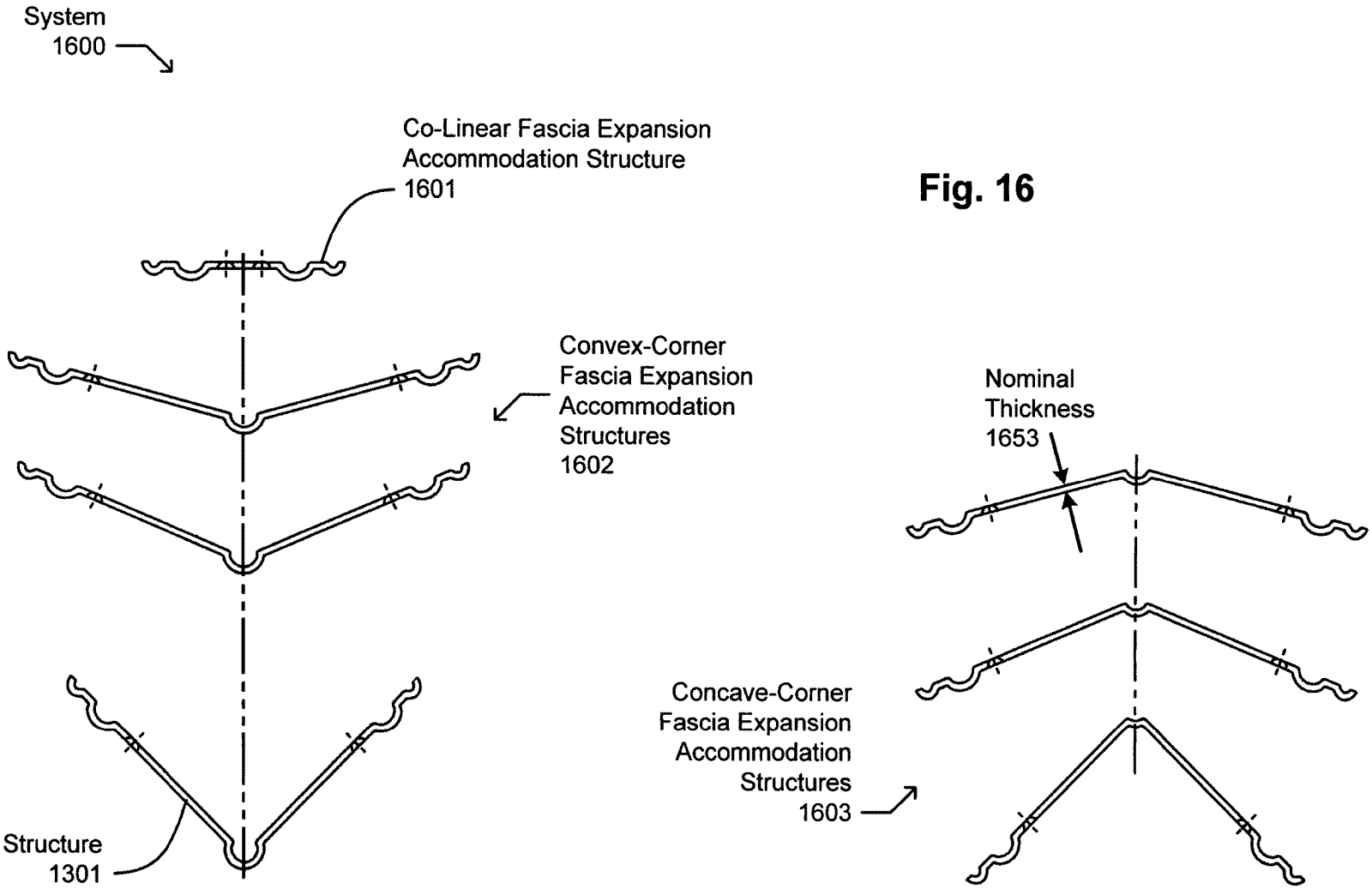
FIG. 16 depicts several additional fascia expansion accommodation structures.

FIG. 16 depicts another context in which one or more technologies may be implemented, a decking system 1600 that includes the convex-corner fascia expansion accommodation structure 1301 depicted in FIGS. 13-15 with regard to joists nominally mounted at right angles (like those of FIGS. 2 & 9, e.g.). System 1600 provides an inventory that also includes a co-linear fascia expansion accommodation structure 1601 and a plurality of convex-corner fascia expansion accommodation structures 1602 (for use in contexts like those described above with joists at obtuse angles, e.g.). See FIG. 11. The inventory of system 1600 likewise includes a plurality of concave-corner fascia expansion accommodation structures 1603 (for use in contexts like those described above with joists at reflex angles, e.g.). See FIG. 12.

In some variants (of deck 100 or deck 300, e.g.), the respective first mounting layers 1442 and second mounting layers 1443 thereof may be configured generally as described with regard to FIG. 14 insofar that each fascia-expansion-accommodation corner covering in the inventory of system 1600 (having a substantially uniform nominal thickness 1653 of at least about 0.5 millimeters and at most about 5 millimeters over at least 80% of the area thereof, e.g.) may be configured to include a corresponding fascia expansion accommodation structure (as shown in FIG. 16) and first and second spacers 1421, 1422. In use at least a single "first" fastener 1446 may hold the first spacer 1421 in contact with both a fascia expansion accommodation structure 1301, 1602, 1603 and the first joist (a deck rim joist 1234, 1434 as described above, e.g.). Likewise a "second" fastener 1447 may hold the second spacer 1422 in contact with both the fascia expansion accommodation structure and the second joist (a deck joist 1236, 1436 as described above, e.g.).

Alternatively or additionally, the respective first mounting layers 1542 and second mounting layers 1543 thereof may be configured generally as described with regard to FIG. 15 insofar that each fascia-expansion-accommodation corner covering in the inventory (having a substantially uniform nominal thickness 1653 of at least about 0.5 millimeters and at most about 5 millimeters over at least 80% of the area thereof, e.g.) may be affixed (in use) to the first and second joists each by a plurality of fascia board fasteners, the first and second deck fascia boards each having a fastener non-engagement aperture 1586 through which one or more gap-spanning fasteners 1596 that support the fascia-expansion-accommodation corner covering pass.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configurable to," "operable/operative to," "adapted/adaptable," "able to," "conformable/conformed to," etc. Those skilled in the art will recognize that "configured to" can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B" in respective included configurations.

With respect to the numbered clauses and claims expressed below, all terms therein identify or describe one or more entities described above with particularity. With regard to methods described herein, those skilled in the art will appreciate that recited operations may generally be performed in any order, unless context dictates otherwise. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise. Also in the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

CLAUSES

1. A decking system comprising:

a fascia-expansion-accommodation corner covering (any of fascia expansion accommodation structures 104, 1004, 1102, 1103, 1201, 1202, 1203, 1301, 1602, 1603, e.g.) having a first mounting layer and a second mounting layer and a stress distribution hinge, the first and second mounting layers each having a mounting surface and a fascia expansion overlap lip (any of lips 1150, 1250, 1450, 1550, e.g.), the stress distribution hinge (any of hinges 1141, 1241, 1441, 1541, e.g.) operably coupling the first mounting layer to the second mounting layer so that a half-plane (either of 1162, 1262, e.g.) adjacent the mounting surface of the first mounting layer and a half-plane adjacent the mounting surface of the second mounting layer are both bounded by a single line (substantially) along the stress distribution hinge and so that the fascia expansion overlap lip of the first mounting layer is configured to remain laterally (substantially) adjacent a first deck fascia board (any of deck fascia boards 133, 232, 233, 1032, 1033, 1231, 1232, 1432, 1433, 1532, 1533, e.g.) irrespective of a longitudinal expansion of or contraction of the first deck fascia board (of deck fascia board 1032 along axis 1072 or of deck fascia board 1033 along axis 1073, e.g.) and so that the fascia expansion overlap lip of the second mounting layer is configured to remain laterally adjacent a second deck fascia board irrespective of a longitudinal expansion of or contraction of the second deck fascia board.

2. The decking system of any of the above SYSTEM CLAUSES further comprising:

the fascia expansion overlap lip (lip 1250, e.g.) of the first mounting layer being less than half as thick as a remainder of the first mounting layer (mounting layer 1155, e.g.), the fascia expansion overlap lip of the second mounting layer being less than half as thick as a remainder of the second mounting layer.

3. The decking system of SYSTEM CLAUSE 1 further comprising:

the fascia expansion overlap lip (lip 1450, e.g.) of the first mounting layer being about as thick (within a factor of two, e.g.) as a remainder of the first mounting layer (either of layers 1442, 1443, e.g.), the fascia expansion overlap lip of the second mounting layer being about as thick as a remainder of the second mounting layer.

4. The decking system of any of the above SYSTEM CLAUSES further comprising:

a first joist (any of deck rim joists 234, 1434 or deck joists 236, 1436, e.g.);

a second joist;

the first deck fascia board, being affixed to the first joist by a plurality of fascia board fasteners; and the second deck fascia board, being affixed to the second joist by a plurality of fascia board fasteners, the fascia-expansion-accommodation corner covering including a fascia expansion accommodation structure and first and second spacers, a first fastener 1446 holding the first spacer 1421 in contact with both the fascia expansion accommodation structure 1301 and the first joist, a second fastener 1447 holding the second spacer 1422 in contact with both the fascia expansion accommodation structure 1301 and the second joist, the fascia-expansion-accommodation corner covering including the fascia expansion overlap lip of the first mounting layer and including the fascia expansion overlap lip of the second mounting layer, the first spacer being a component of the first mounting layer and about as thick as the first deck fascia board 1432, the second spacer being a component of the second mounting layer and about as thick as the second deck fascia board 1433.

5. The decking system of any of the above SYSTEM CLAUSES 1-3 further comprising:

a first joist;

a second joist;

the first deck fascia board, being affixed to the first joist by a plurality of fascia board fasteners; and the second deck fascia board, being affixed to the second joist by a plurality of fascia board fasteners, the first and second deck fascia boards each having a fastener non-engagement aperture (item 1586, e.g.) through which one or more gap-spanning fasteners (item 1596, e.g.) that support the fascia-expansion-accommodation corner covering pass.

6. The decking system of any of the above SYSTEM CLAUSES further comprising:

the single line being substantially vertical (within at most about 2°, e.g).

7. The decking system of any of the above SYSTEM CLAUSES further comprising:

the stress distribution hinge having a length (in a direction parallel to the single line, e.g.) of at least about 2 centimeters.

8. The decking system of any of the above SYSTEM CLAUSES further comprising:

the stress distribution hinge having a length (in a direction parallel to the single line, e.g.) of at most about 20 centimeters.

9. The decking system of any of the above SYSTEM CLAUSES further comprising:

the stress distribution hinge being at least about 0.5 millimeters thick (at its thinnest position, e.g.).

10. The decking system of any of the above SYSTEM CLAUSES further comprising:

the stress distribution hinge being at most about 5 millimeters thick (at its thinnest position, e.g.).

11. The decking system of any of the above SYSTEM CLAUSES further comprising:

an entirety of the stress distribution hinge being at least 2 millimeters from the single line along the stress distribution hinge.

12. The decking system of any of the above SYSTEM CLAUSES further comprising:

an entirety of the stress distribution hinge being at most 2 centimeters from the single line along the stress distribution hinge.

13. The decking system of any of the above SYSTEM CLAUSES further comprising:

the half-plane adjacent (at least) the mounting surface of (at least) the first mounting layer and (at least) the half-plane adjacent (at least) the mounting surface of (at least) the second mounting layer forming a (nominal) right angle spanning (at least) both a joist that supports the first deck fascia board and a joist that supports the second deck fascia board, the fascia-expansion-accommodation corner covering being a convex-corner fascia expansion accommodation structure.

14. The decking system of any of the above SYSTEM CLAUSES further comprising:

the half-plane adjacent the mounting surface of the first mounting layer and the half-plane adjacent the mounting surface of the second mounting layer forming an obtuse angle (nominally equal to 135° or 150°, e.g.) spanning both a joist that supports the first deck fascia board and a joist that supports the second deck fascia board, the fascia-expansion-accommodation corner covering being a convex-corner fascia expansion accommodation structure (any of items 1004, 1102, 1103, 1301, 1602, e.g.).

15. The decking system of any of the above SYSTEM CLAUSES 1-13 further comprising:

the half-plane adjacent the mounting surface of the first mounting layer and the half-plane adjacent the mounting surface of the second mounting layer forming a reflex angle (reflex angle 1268, e.g.) spanning both a joist that supports the first deck fascia board (deck fascia board 1231, e.g.) and a joist that supports the second deck fascia board (deck fascia board 1232, e.g.), the fascia-expansion-accommodation corner covering being a concave-corner fascia expansion accommodation structure (any of items 1201, 1202, 1203, 1603, e.g.).

16. The decking system of any of the above SYSTEM CLAUSES further comprising:

the first and second mounting layers (any of layers 1042, 1043, 1155, 1442, 1443, 1542, 1543, e.g.) and the stress distribution hinge all having been formed of a single composition (vinyl or a mixture comprising a polymer, e.g.).

17. The decking system of any of the above SYSTEM CLAUSES further comprising:

the first mounting layer having a longitudinally recessed surface 1151 that forms a gap depth (between the fascia expansion overlap lip of the first mounting layer and the half-plane 1162, 1262 adjacent the mounting surface 1156, 1256 of the first mounting layer, e.g.) of at least about 2 millimeters, the gap depth being at least about equal to a thickness of the first deck fascia board.

18. The decking system of any of the above SYSTEM CLAUSES further comprising:

the first mounting layer having a longitudinally recessed surface that forms a gap depth (depth 1154, e.g.) of at most about 2 centimeters, the gap depth being at least about equal to a thickness of the first deck fascia board.

19. The decking system of any of the above SYSTEM CLAUSES further comprising:

the first and second mounting layers (any of layers 1042, 1043, 1155, 1442, 1443, 1542, 1543, e.g.) each having a nominal thickness of at least about 0.5 millimeters.

20. The decking system of any of the above SYSTEM CLAUSES further comprising:

the first and second mounting layers and the stress distribution hinge (any of hinges 1141, 1241, 1441, 1541, e.g.) all having been formed integrally by a single injection molding process (with one or more other processes but without a second injection molding process, e.g.)

21. The decking system of any of the above SYSTEM CLAUSES further comprising:

the first and second mounting layers each having a nominal thickness of at most about 5 millimeters.

22. The decking system of any of the above SYSTEM CLAUSES further comprising:

the first and second mounting layers (any of layers 1042, 1043, 1155, 1442, 1443, 1542, 1543, e.g.) each having a nominal thickness of at least about 3 millimeters.

23. The decking system of any of the above SYSTEM CLAUSES further comprising:

the first and second mounting layers each having a nominal thickness of at most about 3 centimeters.

24. The decking system of any of the above SYSTEM CLAUSES further comprising:

the fascia expansion overlap lips (any of lips 1150, 1250, 1450, 1550, e.g.) each having a nominal length of at least about 2 millimeters.

25. The decking system of any of the above SYSTEM CLAUSES further comprising:

the fascia expansion overlap lips each having a nominal length of at most about 2 centimeters.

26. The decking system of any of the above SYSTEM CLAUSES further comprising:

the fascia expansion overlap lips each having a length greater than its thickness.

27. The decking system of any of the above SYSTEM CLAUSES further comprising:

a railpost support interface (any of interfaces 260, 360, 960, e.g.) that includes a first mounting layer and a second mounting layer welded together and both welded to a substrate of the railpost support interface, the first mounting layer of the railpost support interface constructed and arranged to be supported by a first joist that also supports the first deck fascia board (any of deck fascia boards 133, 232, 1032, 1232, 1433, 1532, e.g.), the second mounting layer of the railpost support interface being constructed and arranged to be supported by a second joist that also supports the second deck fascia board.

28. The decking system of any of the above SYSTEM CLAUSES further comprising:

a railpost support interface that includes a substrate supporting several baseplate support bosses (four or more bosses 513, 713, e.g.) and a rigid undercarriage welded to the substrate, the railpost support interface being supported by one or more fasteners having been (inserted through a joist and) self-tapped into the undercarriage, the railpost support interface constructed and arranged to be supported by (at least) a first joist that also supports the first deck fascia board.

29. The decking system of any of the above SYSTEM CLAUSES further comprising:

a railpost support (any of items 320, 520, 920, e.g.) that includes a baseplate and a plurality of flexible finger mounts and a sleeve section, one or more tensile elements (screws configured to extend downward through the baseplate into a threaded portion of the railpost support interface, e.g.) being configured to hold the baseplate removably in rigid engagement with a railpost support interface mounted adjacent at least one of the first deck fascia board or the second deck fascia board, (a top of the railpost support interface being nominally flush with a top of the deck, e.g.) the sleeve section configured to be supported by the baseplate and to support the flexible finger mounts in contact with a railpost inserted (nominally vertically, e.g.) into the sleeve section.

30. The decking system of any of the above SYSTEM CLAUSES further comprising:

a deck (deck 100 or deck 300, e.g.) comprising first and second joists and the first deck fascia board mounted on the first joist and the second deck fascia board mounted on the second joist and the fascia-expansion-accommodation corner covering substantially covering both a front of an end portion of the first deck fascia board and a front of an end portion of the second deck fascia board.

31. The decking system of any of the above SYSTEM CLAUSES further comprising:

a deck that includes the fascia-expansion-accommodation corner covering, the first and second deck fascia boards, and one or more other deck or deck railing components identified in the respective SYSTEM CLAUSE(S).

32. A decking method comprising:

configuring a first joist and a second joist to form a corner therebetween; mounting a first deck fascia board medially covering a front of the first joist but not distally covering the front of the first joist;

mounting a second deck fascia board medially covering a front of the second joist but not distally covering the front of the second joist;

mounting a fascia-expansion-accommodation corner covering as described in any of the above SYSTEM CLAUSES so that the fascia expansion overlap lip of the first mounting layer thereof is configured to remain in front of (laterally adjacent, e.g.) the first deck fascia board irrespective of a longitudinal expansion of or contraction of the first deck fascia board and so that the fascia expansion overlap lip of the second mounting layer thereof is configured to remain in front of (laterally adjacent, e.g.) a second deck fascia board irrespective of a longitudinal expansion of or contraction of the second deck fascia board.

All of the patents and other publications referred to above (not including websites) are incorporated herein by reference generally—including those identified in relation to particular new applications of existing techniques—to the extent not inconsistent herewith. While various system, method, article of manufacture, or other embodiments or aspects have been disclosed above, also, other combinations of embodiments or aspects will be apparent to those skilled in the art in view of the above disclosure. The various embodiments and aspects disclosed above are for purposes of illustration and are not intended to be limiting, with the true scope and spirit being indicated in the final claim set

What is claimed is:

1. A decking system comprising:

a first fascia board and a second fascia board;

a first joist and a second joist;

a fascia-expansion-accommodation corner covering having a first mounting layer and a second mounting layer and a stress distribution hinge; the first and second mounting layers each having a longitudinal axis, the first and second mounting layers each having a mounting surface, the mounting surface of the first mounting layer facing a surface of the first joist, the mounting surface of the second mounting layer facing a surface of the second joist, each of the first and second mounting layers comprising an exterior surface with a fastener slot extending along a respective longitudinal axis of each mounting layer and receiving at least one fastener to fasten the mounting layers to a respective joist, the stress distribution hinge operably coupling the first mounting layer to the second mounting layer, the first mounting layer and second mounting layer each having a fascia expansion overlap lip, wherein the fascia expansion overlap lip of the first mounting layer extends beyond the mounting surface on the longitudinal axis of the first mounting layer and the fascia expansion overlap of the second mounting layer extends beyond the mounting surface on the longitudinal axis of the second mounting layer;

wherein the fascia expansion overlap lip of the first mounting layer and the surface of the first joist form a gap, wherein the gap is disposed to accept an edge of the first fascia board wherein the fascia expansion overlap lip of the first mounting layer overlaps with the edge of the first fascia board wherein the gap accommodates the first fascia board as the first fascia board expands or contracts;

wherein the fascia expansion overlap lip of the second mounting layer and the surface of the second joist form a gap, wherein the gap formed by the second mounting layer and second joist is disposed to accept an edge of the second fascia board wherein the fascia expansion overlap lip of the second mounting layer overlaps with the edge of the second fascia board wherein the gap formed by the second mounting layer and second joist accommodates the second fascia board as the second fascia board expands or contracts.

2. The decking system of claim 1, wherein the stress distribution hinge has a curved body, having a convex surface, a concave surface, a first end, and a second end opposite the first end, the first end connecting to the first mounting layer, the second end connecting to the second mounting layer.

3. The decking system of claim 2, wherein the first and second mounting layers and the stress distribution hinge are all formed of a single composition.

4. The decking system of claim 2, wherein the first joist is connected to the first fascia board using one or more fasteners and the second joist is connected to the second fascia board using one or more fasteners.

5. The decking system of claim 4, wherein the at least one fastener connecting the first joist to the first mounting layer and the at least one fastener connecting the second joist to the second mounting layer are covered by a respective removable slot cover.

6. The decking system of claim 2, wherein the fascia-expansion-accommodation corner covering is comprised of a plastic material.

7. The decking system of claim 1, wherein the fascia-expansion-accommodation corner covering adapts to angles formed by the first deck joist and the second deck joist ranging from 90 to 270 degrees.

8. A decking method comprising:

configuring a first joist and a second joist to form a corner there between;

mounting a fascia-expansion-accommodation corner covering having a first mounting layer and a second mounting layer and a stress distribution hinge; the first and second mounting layers each having a longitudinal axis, the first and second mounting layers each having a mounting surface, the mounting surface of the first mounting layer facing a surface of the first joist, the mounting surface of the second mounting layer facing a surface of the second joist, each of the first and second mounting layers comprising an exterior surface with a fastener slot extending along a respective longitudinal axis of each mounting layer and receiving at least one fastener to fasten the mounting layers to a respective joist, the stress distribution hinge operably coupling the first mounting layer to the second mounting layer, the first mounting layer and second mounting layer each having a fascia expansion overlap lip, wherein the fascia expansion overlap lip of the first mounting layer extends beyond the mounting surface on the longitudinal axis of the first mounting layer and the fascia expansion overlap of the second mounting layer extends beyond the mounting surface on the longitudinal axis of the second mounting layer;

mounting a first fascia board; wherein the fascia expansion overlap lip of the first mounting layer and the surface of the first joist form a gap, wherein the gap is disposed to accept an edge of the first fascia board wherein the fascia expansion overlap lip of the first mounting layer overlaps with the edge of the first fascia board wherein the gap accommodates the first fascia board as the first fascia board expands or contracts;

wherein the fascia expansion overlap lip of the second mounting layer and the surface of the second joist form a gap, wherein the gap formed by the second mounting layer and second joist is disposed to accept an edge of the second fascia board wherein the fascia expansion overlap lip of the second mounting layer overlaps with the edge of the second fascia board wherein the gap formed by the second mounting layer and second joist accommodates the second fascia board as the second fascia board expands or contracts.

9. The decking method according to claim 8, further comprising fastening the fascia expansion-accommodation corner covering directly to the first joist and second joist.

10. The decking method of claim 9, wherein the stress distribution hinge has a curved body, having a convex surface, a concave surface, a first end, and a second end opposite the first end, the first end connecting to the first mounting layer, the second end connecting to the second mounting layer.

11. The decking method of claim 10, wherein the first and second mounting layers and the stress distribution hinge are all formed of a single composition.

12. The decking method of claim 10, wherein the fascia-expansion-accommodation corner covering is comprised of a plastic material.

13. The decking method of claim 8, wherein the fascia-expansion-accommodation corner covering adapts to angles formed by the first deck joist and the second deck joist ranging from 90 to 270 degrees.

14. The decking method of claim 8, wherein the first deck joist and the second deck joist form an angle at the fascia-expansion-accommodation corner covering of at least 90 degrees to at most 270 degrees.

* * * * *